United States Patent [19]

Ishizuka

[11] 4,403,769

[45] Sep. 13, 1983

[54] VACUUM SEPARATOR

[76] Inventor: Hiroshi Ishizuka, 19-2, Ebara 6-chome, Shinagawa-ku, Tokyo, Japan

[21] Appl. No.: 371,417

[22] Filed: Apr. 23, 1982

[30] Foreign Application Priority Data

May 12, 1981 [JP] Japan ..... 56-71118

[51] Int. Cl.[3] ..... F27B 5/04

[52] U.S. Cl. ..... 266/149; 373/110; 75/10 R; 75/84

[58] Field of Search ..... 266/149; 373/110; 75/10, 84

[56] References Cited

U.S. PATENT DOCUMENTS

| | | | |
|---|---|---|---|
| 2,391,156 | 12/1945 | Hansgirg | 266/149 |
| 2,404,328 | 7/1946 | Turin et al. | 266/149 |
| 3,684,264 | 8/1972 | Petrov et al. | 266/149 |

*Primary Examiner*—M. J. Andrews
*Attorney, Agent, or Firm*—Larson and Taylor

[57] ABSTRACT

In a vacuum separator for refractory metal from magnesium metal and magnesium chloride mixed therewith, comprising: a vertically elongated substantially cylindrical retort having, inside, a closed space, a lower section of which is capable of accommodating such mixture to be treated as held in a container and is provided with a heating means to evaporate the magnesium metal and magnesium chloride to a substantial part, and an upper section of which has a cooling means to provide, inside, a cylindrical face for condensing thereon magnesium metal and magnesium chloride which ascend as vapor, and a means for degassing the retort to an elevated level of vacuum, an improvement such that a heat shield unit is provided at an intermediate level between said upper and lower sections of the retort, said heat shield unit comprising, as a whole, opening so arranged as to block any direct sight of the surface of the retort lower section when holding the container from a substantial part of the condensation face in the upper section, thus intercepting a substantial part of primary heat radiation from the retort lower section, while allowing passage of ascending vapor

9 Claims, 2 Drawing Figures

VACUUM SEPARATOR

Figure 1:
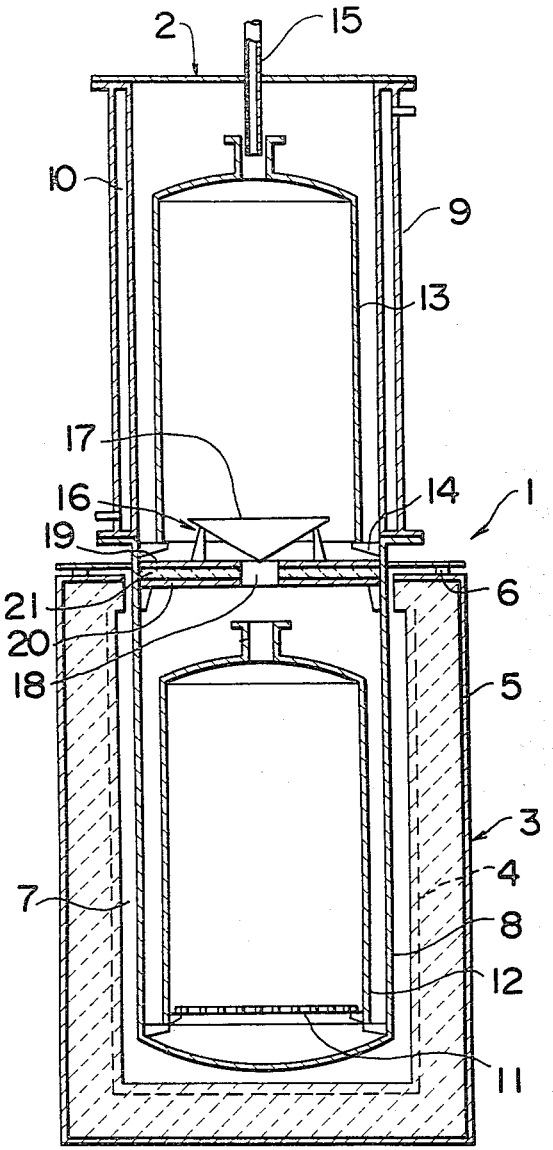

The present invention relates to a vacuum separator, or, an apparatus for removal of magnesium dichloride and magnesium metal coexisting with titanium or zirconium metals as recovered from a Kroll process wherein tetrachloride of such metals is reduced with fused magnesium metal.

In the production of titanium or zirconium metal, the so-called Kroll process is generally utilized by which metal chloride is converted to metal sponge with fused magnesium as reducing agent which is charged usually in an amount in excess of the stoichiometry to complete the reduction, thus leaving magnesium metal as unconsumed as well as magnesium chloride byproduct when the process is ended. Thus, with the product metal accompanied with such inclusions, a mass as recovered from the reduction process is essentially subjected to vacuum separation, or a fractional distillation in a vacuum, for purification of the metal, by evaporating in a zone of vacuum separator such inclusions as magnesium metal and magnesium chloride at a temperature on the order of 1000° C., which then are condensed for recovery in another zone of the apparatus.

For such purification of the metal an elongated vertical arrangement is especially employed which basically comprises a retort to contain a crucible loaded with a reaction mass in the upper half which is placed in a furnace, while the lower half is provided with a cooling means, as known, for example, from U.S. Pat. No. 3,663,001. This design is generally employed as favorable because of rather a high treatment efficiency since the metal and chloride inclusions flow down from the upper zone to the lower zone as cooled, in a liquid state as well as vaporous.

Meanwhile, since the reduction process of such metal chloride with magnesium is practised in batches, an increased capacity treatable in each run is desirable as advantageous in production economy. Obviously, use of a crucible of increased dimensions for this purpose requires a vacuum separator of accordingly increased capacity. With the conventional techniques as said above, however, a substantially increased cost is involved in plant construction due to an essential separator which has a necessarily so rigid and costly construction especially in the lower zone that a considerable weight can be upheld of the crucible of a substantially increased mass as well as a furnace enlarged accordingly. Further cumbersome and rather dangerous operation with possible human injury and/or equipment breakdown are necessary when such massive furnace essentially is moved up and down and transferred every run for mounting and dismounting every run. In addition, with the top not available for heater arrangement, the furnace should have a substantially elongated construction for supplying from around a sufficient heat to evaporate inclusion at the bottom of the mass being treated. This also results in an additional expense in plant construction.

Therefore, with an increased volume to be treated per batch, another separator arrangement is favored in which, as known from U.S. Pat. No. 4,105,192, for example, such retort has a lower half to be heated with a furnace around it and an upper half to be cooled so that a crucible placed on the bottom in the lower half is heated to evaporate out of metal product inclusions which are then caught as condensed in the upper zone.

This construction is advantageous in that provision of a furnace of an increased weight is readily realized, in a simplified placement of a crucible as holding the metal product mixed with the inclusions, and in that the furnace bottom is available for heater provision so that a furnace of a substantially shortened design is effectively usable as a result of an efficient heat supply to the bottom of the crucible for removing the inclusions there. In case especially where another crucible as evacuated is used in the upper zone to deposit condensates of the magnesium metal and chloride, and where such deposited condensates are put in a Kroll process as attached to the crucible, the metal is used as reducing agent while the chloride can be discharged out of the retort together with in-situ formed magnesium chloride, thus saving labor and resulting recovery loss, involved with otherwise necessary step of scraping such condensates.

Although this arrangement thus exhibits some merits in treatment of metal batches of an increased mass, conventional vacuum separators in use involve an inevitable drawback: condensates once formed on the wall in the cooling zone tend often to drop in the process into the lower zone, where they must be heated to be vaporous again, and as a result, a substantially increased treatment time is necessary relative to the first mentioned separator design by which the cooling zone is positioned over the evaporation zone.

The Inventor has observed that such condensate drop is most likely to be caused by the heat primarily radiated from the lower zone of the retort wall placed in a furnace, as this is seen to happen at a late stage where vaporization of magnesium metal and chloride is small and slow, so the vacuum level is high, and since this is also seen when temperature rise is rapid to fast evaporate the inclusions. This apparently results from low cooling efficiency through such a porous structure of condensates as well as a small adhesion to the cooled wall. A slowed heat supply however, is unfavorably results in an increased process time to lower metal productivity.

Therefore, the principal objective of the present invention is to provide a vacuum separator design removed of the drawbacks, as described above, involved with conventional techniques. Such objective has been fulfilled according to the invention, by providing a separator arrangement wherein a mixed mass to be treated is placed in the lower section, with an adequate heat shield means to intercept primary heat radiation to a substantial part from below, such means being provided at an intermediate level between the lower and upper sections of the retort, thus allowing individual temperature regulation such that the lower section (evaporation section) may be kept at a temperature level over 900° C. so as to effectively evaporate magnesium metal and chloride to separate from the metal product, while the upper section (condensation section) is at a temperature below 650° C. so that such magnesium metal and magnesium chloride may not be fused again to fall apart from a condensation face which is conveniently provided on an evacuated crucible of a similar construction as used below placed in this section.

According to the invention there is provided in a vacuum separator for refractory metal from magnesium metal and magnesium chloride mixed therewith, comprising: a vertically elongated substantially cylindrical retort having, inside, a closed space, a lower section of which is capable of accomodating such mixture to be treated as held in a container and is provided with a heating means to evaporate the magnesium metal and magnesium chloride to a substantial part, and an upper section of which has a cooling means to provide, inside, a cylindrical face for condensing thereon magnesium metal and magnesium chloride which ascend as vapor, and a means for degassing the retort to an elevated level of vacuum, an improvement such that a heat shield unit is provided at an intermediate level between said upper and lower section of the retort, said heat shield unit comprising, as a whole, opening so arranged as to block any direct sight of the surface of the retort lower section when holding the container from a substantial part of the condensation face in the upper section, thus intercepting a substantial part of primary heat radiation from the retort lower section, while allowing passage of ascending vapor.

In the invention the heat shield unit may take various setups as far as it meets the criteria: blocking of primary heat radiation, to a substantial part, to the condensation face from the retort wall as heated and passage for ascending vapor of magnesium metal and chloride. The unit basically consists of one circular plate with a central opening, which is usually circular, too, with an additional plate or an additional set of plates with a central bore, similarly shaped or otherwise, placed with a substantial distance between the top and bottom of the row, relative to the dimensions and shape of the opening. Such additional plates, partly or as a whole, may be replaced with a body otherwise constructed, such as a solid disk, a cone or a series of conical rings of a same or different diameters with a cone atop, the disk or cone or other conical bodies as a whole having a cross section larger than that of the opening and being arranged in adjacence to cover the opening. Each of such elements as said above consists of steel, and preferably of stainless steel. The plates to compose the unit favorably have a bottom side finish polished or ground for an improved reflectivity for heat radiation from below. Heat insulative of non-metallic material, such as carbon fiber is advantageously utilized as inserted between adjacent plates or as overlaid on the condenser-section end of the plate or plates.

Figure 2A:
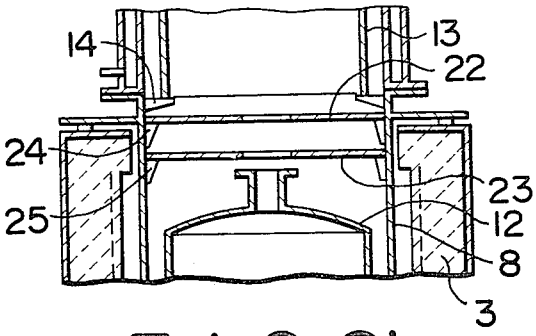
Figure 2B:
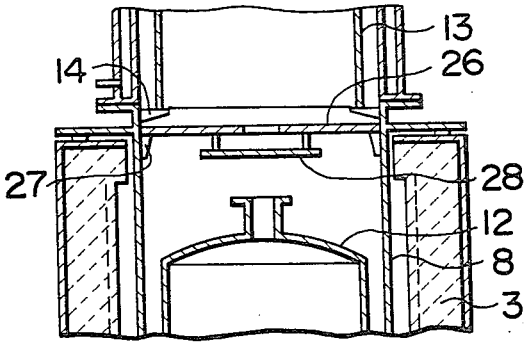
Figure 2C:
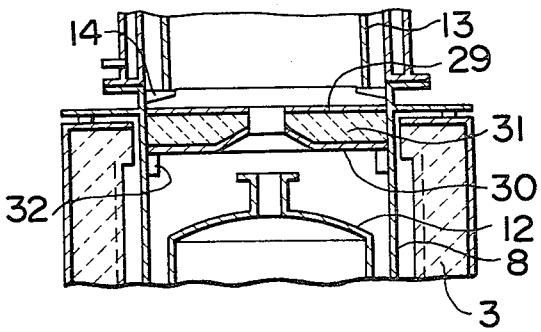

Other features of the invention and advantages achieved thereby will be better understood from the following description taken in connection with the accompanying drawing which is given by way of example only and not for limiting the invention. Of the drawing:

FIG. 1 illustrates a schematic view in section of a vacuum separator constructed according to the invention, while FIG. 2 shows a few variations in particular of heat shield unit of the invention.

In the figures a vacuum separator, generally designated at 1, comprises an elongated substantially cylindrical retort 2 of steel partly placed in a furnace 3 having an electroresistive heating element 4 on the bottom as well as on the cylindrical wall. Encased in a metallic shell 5 and provided with a heat resistive packing 6 between the furnace 3 and retort 2, the interspace 7 formed therebetween is pressure regulatable with a conventional means (not shown). The retort 2 has divisibly connected lower portion 8 to provide an evaporation section, placed in the furnace 3, and an upper portion 9, to provide a condensation section, having therearound a jacket 10 to pass coolant water therethrough. The lower portion 8 accomodates such metallic product as titanium or zirconium in a sponge form mixed with magnesium metal and magnesium chloride as held on a perforated grate 11 in a crucible 12. The upper portion 9, which is arranged as protrudent from the furnace 3, may favorably accomodate another crucible 13 on a set of detachable stoppers 14 as evacuated and removed of the grate for condensing to deposit upcoming magnesium vapor of metal and magnesium chloride. The retort 2 has a pipe 15 for degassing connected at a top portion. The retort essentially has a heat shield unit 16 over the crucible 12 in a vicinity of the joint of two portions 8, 9. The unit 16, as illustrated in the figures, takes various setups. FIG. 1 particularly shows a design which consists of a cone 17 of steel supported on and arranged so as to cover entirely a central round opening 18 of disks or circular plates 19, 20 of steel arranged at a spacing and inserted with a heat insulative 21, such as carbon fiber, therebetween. Such heat shield unit as a whole is detachable from the retort 2 when the latter is divided. FIG. 2 shows other variations at (a) to (c): a pair of steel disks 22, 23 with a similar central bore are rested on each stopper set 24, 25 at a space without any insert (a), a disk 26 with a central opening, resting on a stopper set 27, has an attachment thereto of a solid disk 28 of a cross section capable of covering the opening at the given space from below (b), and a set of a flat circular plate 29 and a flanged conical ring 30, each with a central bore, have therebetween a stuff of heat insulative material 31 and detachably placed on a stopper set 32. A typical example using such arrangement will be given.

EXAMPLE

An electroresistive furnace of a substantially cylindrical form was used which measured 2 m in I.D. and 4 m in inside length, and had thereinside a substantial part of the lower portion of a retort which measured 1.6 m in I.D. and 32 mm in thickness and consisted of stainless steel. In the retort placed was a crucible of also a stainless steel, which had a 1.4 m in O.D., a 16 mm thickness and 2.4 m in entire length, and held some 4 (metric) tons of titanium sponge, as mixed with a minor amount of magnesium metal and chloride inclusions. As a heat shield unit two disks of, each, a 2 mm thickness and a circular central opening some 30 cm across were arranged over the crucible at a space of 10 cm from each other. On such disks atop there were supported a solid disk 100 cm across and 2 mm thick, as spaced with leg members. The disks as well as the cone and leg members in this example each consisted of stainless steel. Over the shield unit a set of stoppers was attached to the retort and a blank crucible of a similar construction was seated thereon, and the upper half was mounted to connect with the lower half to build up a retort. The retort thus set up was degassed through the pipe atop, while it was heated in the lower half from outside to a temperature level between 950° and 1000° C. at a rate of 50° C./hour, while cooling the upper portion which circulating water. A vacuum of $3\times10^{-1}$ Torr was reached in some 40 hours from the outset of degassing. Treatment was practised at the temperature for 60 hours to complete. This achievement consists a substantial improvement over conventional techniques, without employment of the heat shield unit of the invention, which typically takes some 90 hours for treatment of such amount of titanium metal.

As described above in detail, the invention, whereby condensates of magnesium metal and magnesium chloride are effectively prevented from falling into the crucible at the evaporation section, permits a substantial improvement in productivity as a result of raised separation efficiency of inclusions from sponge product of refractory metal.

I claim:

1. In a vacuum separator for separating refractory metal from contaminants of magnesium metal and magnesium chloride mixed therewith, said vacuum seprator comprising a vertically elongated substantially cylindrical retort defining a closed space thereinside, a chamber capable of accomodating such mixture as loaded in a container, heating means for effecting evaporation of a substantial portion of said contaminants from such mixture, said chamber and heating means being provided in a lower section of the retort, a cylindrical surface, provided by an inside surface of another container for depositing thereon the contaminants which ascend in said retort as vapor, cooling means for effecting condensation of such contaminants on said surface, said surface and cooling means being provided in an upper section of said retort, and means for degassing the retort to an elevated degree of vacuum; the improvement wherein:

said retort further comprises a heat shield unit at an intermediate level between said upper and lower sections of the retort, said heat shield unit comprising a circular plate with a central bore and a flat solid disc larger than the bore, said disc being attached to but spaced from said circular plate, each of said circular plate and disc consisting of steel and being arranged at such a distance from one another, in relation to the bore, that the heat shield unit as a whole blocks any direct sight of the surface of the lower section of the retort, when holding the container loaded with a mixture to be treated, from a substantial part of the condensation surface in the upper section, thus intercepting a substantial part of primary heat radiation from the retort lower section, while allowing passage of ascending vapor of contaminants.

2. A vacuum separator according to claim 1 further comprising a layer of heat insulative material located atop said circular plate.

3. A vacuum separator according to claim 1 wherein the lower surface of said circular plate is ground to provide a heat reflective surface.

4. A vacuum separator according to claim 1 wherein said heat shield unit comprises a further member consisting of steel and arranged at such a distance from said circular plate and disc that the heat shield unit as a whole blocks any direct sight of the surface of the lower section of the retort, when holding the container loaded with a mixture to be treated, from a substantial part of the condensation surface in the upper section, thus intercepting a substantial part of primary heat radiation from the retort lower section, while allowing passage of ascending vapor of contaminants.

5. A vacuum separator according to claim 4 wherein said disc is located on one side of said circular plate and wherein said further member is located on the other side thereof.

6. A vacuum separator according to claim 5 wherein said further member comprises a further circular plate with a central bore, said further plate being spaced therefrom a distance which is substantial relative to the size of said central bore.

7. A vacuum separator according to claim 6 further comprising heat insulative material between said circular plates.

8. A vacuum separator according to claim 5 wherein said further member comprises a cone having a cross section larger than the bore of said circular plate.

9. A vacuum separator according to claim 5 wherein said further member comprises a series of circular rings with a cone atop, said rings and cone having a cross section larger than the bore of said circular plate.

* * * * *